US006778806B2

(12) United States Patent
Chinzei

(10) Patent No.: US 6,778,806 B2
(45) Date of Patent: Aug. 17, 2004

(54) IMAGE-FORMING APPARATUS WITH REDUCED DEVIATION OF CONTINUOUS RECORDING PAPER

(75) Inventor: Kiyoshi Chinzei, Hyogo (JP)

(73) Assignee: Fuji Xerox, Ltd., Tokyo (JP)

( * ) Notice: Subject to any disclaimer, the term of this patent is extended or adjusted under 35 U.S.C. 154(b) by 68 days.

(21) Appl. No.: 10/084,920

(22) Filed: Mar. 1, 2002

(65) Prior Publication Data

US 2003/0095821 A1 May 22, 2003

(30) Foreign Application Priority Data

Nov. 20, 2001 (JP) ..... 2001-354559

(51) Int. Cl.[7] ..... G03G 15/00
(52) U.S. Cl. ..... 399/384
(58) Field of Search ..... 399/384, 388, 399/396; 271/232, 248, 202; 266/4, 6, 29, 30, 42

(56) References Cited

U.S. PATENT DOCUMENTS 4,110,027 A * 8/1978 Sato et al. ..... 399/317
4,943,863 A * 7/1990 Ainoya ..... 399/297
5,481,352 A * 1/1996 Yamamoto et al. ..... 399/384
5,659,871 A * 8/1997 Fujimoto et al. ..... 399/384
5,701,573 A * 12/1997 Yoshiuchi et al. ..... 399/384
5,708,345 A * 1/1998 Kramer et al. ..... 318/696
5,809,390 A * 9/1998 Jackson ..... 399/384

* cited by examiner

*Primary Examiner*—Robert Beatty
(74) *Attorney, Agent, or Firm*—Westerman, Hattori, Daniels & Adrian, LLP

(57) ABSTRACT

An image forming apparatus includes a photosensitive drum, scuff rollers to move a continuous recording paper along a transfer path, a tractor disposed upstream from the scuff rollers, back tension rollers disposed upstream from the tractor to exert a tension on the recording paper, a speed controller to adjust the transfer speed of the recording paper, and a pressure controller to adjust the pressure acting on the recording paper. The speed controller adjusts the circumferential speed of the back-tension rollers and/or scuff rollers and the pressure controller adjusts the pressure of the back-tension rollers and/or scuff rollers in order to reduce positional deviation of the recording paper.

14 Claims, 11 Drawing Sheets

IMAGE-FORMING APPARATUS WITH REDUCED DEVIATION OF CONTINUOUS RECORDING PAPER

BACKGROUND OF THE INVENTION

1. Field of the Invention

The present invention relates to an image-forming apparatus used advantageously for printers or copying machines. In particular, the present invention relates to an electrophotographic image-forming apparatus.

2. Description of the Related Art

Electrophotographic image-forming apparatus have been used in various kinds of printers or copying machines. FIG. 10 of the accompanying drawings shows the basic structure of a conventional image-forming apparatus. The illustrated apparatus includes an image-forming unit 71 to print images on continuous recording paper P, and a paper transfer mechanism 73 to draw out paper P from the paper hopper 72 and feed it to the image-forming unit 71.

The paper transfer mechanism 73 includes scuff rollers 74, back-tension rollers 75, a sub-tractor 76 and a main tractor 77. The scuff rollers 74 exert a forward pulling force on the paper P, while the back-tension rollers 75 exert a backward pulling force (tension) on the paper P. The sub-tractor 76 and the main tractor 77 regulate the transfer speed of the paper P. Each of the tractors 76, 77 includes a pair of tractor belts 77*a* from which a plurality of tractor pins 77*b* project. In a paper feeding operation, the pins 77*b* are brought into engagement with indexing holes of the paper P. FIG. 11 shows a typical indexing hole (reference numeral 78) having a serrated circumference.

The image-forming unit 71 includes a rotatable photosensitive drum 81 upon which an electrostatic latent image is produced. Around the drum 81 are provided a pre-charger 82, a laser emitter 83, a developer 84, a transfer charger 85, an AC discharger 86, a toner cleaner 87 and an LED discharger 88. The functions of these components are as follow. The pre-charger 82 uniformly charges the image-forming surface of the drum 81. The laser emitter 83 irradiates the charge surface with a laser beam to produce an electrostatic latent image in conformity with the original. The latent image is made visible as a toner image by the developer 84. Then, the toner image is transferred onto the paper P by the transfer charger 85. The transferred image is fused to the paper P by application of e.g. heat or pressure from a fixing unit (not shown). The remnant charge on the drum surface is removed by the dischargers 86 and 88, while the remnant toner is removed by the cleaner 87.

In operation, the scuff rollers 74 and the drum 81 are responsible for the forward movement of the paper P, while the back-tension rollers 75 exert a backward force on the paper P so that the paper P is appropriately stretched. To avoid exertion of an unduly strong pulling force on the paper P, the scuff rollers 74 can slip on the paper P. This arrangement is advantageous to avoiding the breakage of the paper P at an indexing hole 78 for example.

While the conventional apparatus is functional, it has the following disadvantage.

In the conventional apparatus, the photosensitive drum 81 can exert a forward pulling force on the paper P while it is held in contact with the paper P. However, at an initial stage of the printing operation where the drum 81 has not come into contact with the paper P yet, the paper P is pulled forward only by the action of the scuff rollers 74. In this situation, the back-tension rollers 75 may pull the paper P backward with a stronger force than the scuff rollers 74 pull the paper P forward. As a result, the paper P may shift backward relative to the main tractor 77, whereby the tractor pins 77*b* come into contact with the front portion of the indexing holes 78 (see FIG. 11).

When the drum 81 is held in contact with the paper P, on the other hand, the paper P is pulled forward more strongly by the combination of the scuff rollers 74 and the drum 81, whereby the tractor pin 77*b* is shifted relatively backward in the indexing hole 78. Thus, as shown in FIG. 12, the pin 77*b* comes into contact with the rear portion of the hole 78.

Disadvantageously, as seen from FIGS. 11 and 12, the tractor pin 77*b* can shift by a maximum distance (A) through the printing session. This deviation may cause a shear in printing, and therefore should be avoided.

SUMMARY OF THE INVENTION

The present invention has been proposed under the circumstances described above. It is, therefore, an object of the present invention to provide an image-forming apparatus which does not suffer the positional deviation of the recording paper relative to the tractor pins.

According to a first aspect of the present invention, there is provided an image-forming apparatus including: a photosensitive member on which an electrostatic latent image is produced; scuff rollers that move recording paper along a transfer path; a tractor disposed upstream of the transfer path from the scuff rollers, the tractor moving the recording paper at a predetermined transfer speed; back-tension rollers disposed upstream from the tractor, the back-tension rollers exerting a tension on the recording paper; and a speed controller that adjusts a transfer speed of the recording paper. The speed controller makes greater the circumferential speed of the back-tension rollers than the transfer speed by the tractor during a period after the recording paper is started to move along the transfer path and before image-printing is begun.

Preferably, the speed controller may make smaller the circumferential speed of the back-tension rollers than the transfer speed by the tractor after the image-printing is begun.

Preferably, the apparatus of the present invention may further include a transfer charger for transferring a toner image onto the recording paper. After a predetermined period of time passes since a beginning of transfer by the transfer charger, the speed controller makes smaller the circumferential speed of the back-tension rollers than the transfer speed by the tractor.

According to a second aspect of the present invention, there is provided an image-forming apparatus including: an image-forming unit that prints an image on recording paper; scuff rollers that move the recording paper along a transfer path; a tractor disposed upstream of the transfer path from the scuff rollers, the tractor moving the recording paper at a predetermined transfer speed; back-tension rollers disposed upstream from the tractor for exerting a tension on the recording paper; and a pressure controller that adjusts a pressing force acting on the recording paper. During a period after the recording paper is started to move along the transfer path and before image-printing is begun, the pressure controller prevents the back-tension rollers from exerting a pressing force on the recording paper.

Preferably, the pressure controller may control the back-tension rollers after the image-printing is begun, so that the back-tension rollers exert a pressing force on the recording paper.

Preferably, the apparatus of the present invention may further include a transfer charger for transferring a toner image onto the recording paper. The pressure controller may cause the back-tension rollers to exert a pressing force on the recording paper after a predetermined period of time passes since the beginning of image transfer performed by the transfer charger.

Preferably, the apparatus of the present invention may further include a mechanism for changing the position of the back-tension rollers. The pressure controller controls the position-changing mechanism to cause the back-tension rollers to selectively exert a pressing force on the recording paper.

Preferably, the back-tension rollers may include a drive roller and a follower roller which faces the drive roller and is moved by the position-changing mechanism.

According to a third aspect of the present invention, there is provided an image-forming apparatus including: an image-forming unit provided with a photosensitive member on which an electrostatic latent image is produced; scuff rollers that move recording paper along a transfer path; a tractor disposed upstream of the transfer path from the scuff rollers, the tractor moving the recording paper along the transfer path at a predetermined transfer speed; back-tension rollers disposed upstream from the tractor for exerting a tension on the recording paper; and a pull controller that adjusts a pulling force acting on the recording paper. The pull controller makes greater a pulling force of the scuff rollers than a pulling force of the back-tension rollers during a period after the recording paper is started to move along the transfer path and before image-printing is begun.

Preferably, in the above apparatus, the pull controller may make greater the sum of the pulling force of the scuff rollers and pulling force of the photosensitive member than the pulling force of the back-tension rollers after the image-printing is begun.

Preferably, the pull controller may make greater the pulling force of the scuff rollers during a period after the recording paper is started to move along the transfer path and before image-printing is begun than after the image-forming is begun.

Preferably, the above apparatus may further include a transfer charger for transferring a toner image onto the recording paper. The pull controller may make greater the sum of the pulling force of the scuff rollers and the pulling force of the photosensitive member than the pulling force of the back-tension rollers after a predetermined period of time passes since a beginning of transfer by the transfer charger.

Preferably, the above apparatus may further include a pressure adjusting mechanism for the scuff rollers. In this case, the pull controller may control the pressure adjusting mechanism, thereby changing the pressing force of the scuff rollers acting on the recording paper.

Preferably, the scuff rollers may include a drive roller and a follower roller which faces the drive roller and is associated with the pressure adjusting mechanism.

Preferably, the above-mentioned predetermined period of time may be determined depending on the forward pulling force of the photosensitive member acting on the recording paper.

Other features and advantages of the present invention will become apparent from the detailed description given below with reference to the accompanying drawings.

DETAILED DESCRIPTION OF THE PREFERRED EMBODIMENT

The preferred embodiments of the present invention will be described below with reference to the accompanying drawings.

Figure 1:
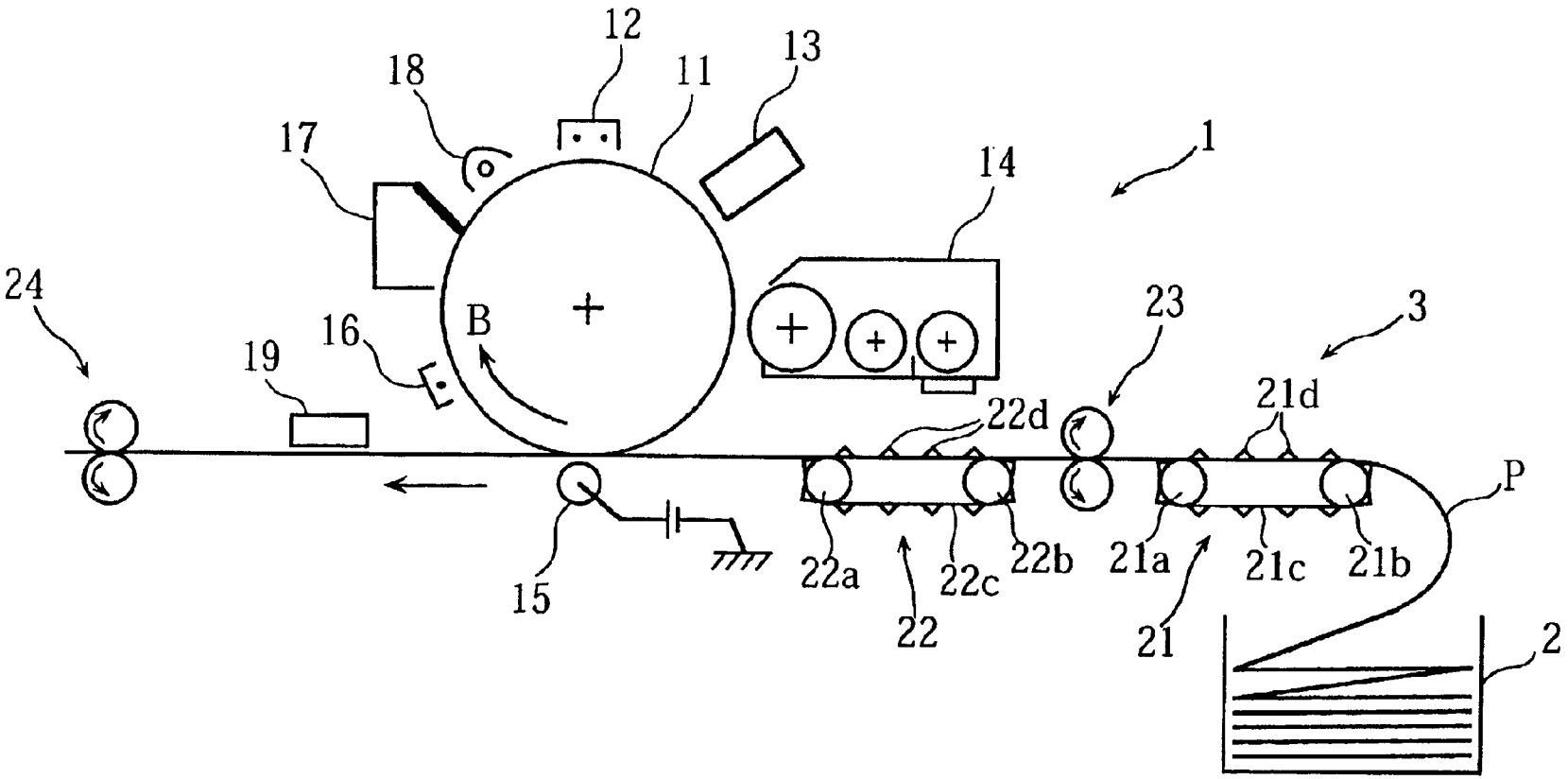
FIG. 1 shows the principal components of an electrophotographic printer provided with an image-forming apparatus according to the present invention.

FIG. 1 shows the principal components of an electrophotographic printer which incorporates an image-forming apparatus embodying the present invention. The printer includes an image-forming unit 1 for making prints on continuous paper P, a paper hopper 2, and a paper feeding unit 3. In a printing operation, the continuous paper P is pulled out from the hopper 2 to be forwarded along the prescribed paper transfer path by the paper feeding unit 3.

The continuous paper P, received in the hopper 2 in an alternately folded manner, is formed with indexing holes disposed at regular intervals along the longitudinal sides of the paper P. The paper P may be perforated at regular intervals so that it can be easily severed into separate sheets.

The image-forming unit 1 includes a rotatable photosensitive drum 11, a pre-charger 12, a laser emitting source 13, a developer 14, a transfer charger 15, an AC discharger 16, a cleaner 17 and an LED discharger 18.

In a printing operation, the photosensitive drum 11 is rotated forward (as indicated by an arrow B in FIG. 1) and held in contact with the paper P. The surface of the drum 11 is uniformly charged by the pre-charger 12.

The laser emitting source 13 may be provided with a semiconductor laser and a polygon mirror. The uniformly charged surface of the drum 11 is irradiated by the laser beam from the laser source 13, so that a latent image is produced on the drum surface in conformity with the original.

The developer 14 makes the latent image visible by dusting the drum surface with a pigmented powder (toner).

The transfer charger 15 is disposed in close facing relation to the drum 11 across the paper transfer path for causing the toner image on the drum 11 to be transferred to the paper P. The transfer charge 15 is movable between a set position adjacent to the surface of the drum 11 and a release position apart from the drum surface. This movement is effected by a shifting unit 41. More specifically, at the beginning of a printing operation, the transfer charger 15 is located in the release position, thereby being widely spaced from the drum surface. Then, when the leading edge of the paper P is fed between the transfer charger 15 and the drum 11, the transfer charger 15 is brought to the set position, so that the paper P is held in pressing contact with the drum surface (the beginning of an image-printing session). Thus, the drum 11, as it rotats, pulls the paper P forward along the transfer path.

The AC discharger 16 and the LED discharger 18 remove the remnant charge on the drum 11. The cleaner 17 removes the remnant toner on the drum 11 after the toner image transfer is performed by the transfer charger 15.

For fixing the transferred toner image to the paper P, a fixing unit 19 is provided adjacent to the paper transfer path at a point downstream from the drum 11. The fixing unit 19 may thermally fuse the toner image to the paper P.

As viewed along the paper transfer path, the paper feeding unit 3 includes a first tractor 21, a second tractor 22, back-tension rollers 23, and scuff rollers 24.

The first tractor 21 includes two pairs of a front pulley 21*a* and a rear pulley 21*b* (only one pair is shown in FIG. 1). One pair is for one longitudinal edge of the paper P, while the other pair for the other longitudinal edge of the paper P. A tractor belt 21*c* extends around each pair of the front and the rear pulleys 21*a*, 21*b*. The tractor belt 21*c* is formed with a plurality of tractor pins 21*d* coming into engagement with the indexing holes of the paper P. In the first tractor 21, the front pulleys 21*a* may be rotated by a motor (not shown) to feed the paper P at a predetermined speed. Like the first tractor 21, the second tractor 22 includes two pairs of a front pulley 22*a* and a rear pulley 22*b*, and two tractor belts 22*c* for the respective pairs of the pulleys 22*a*~22*b*. Each tractor belt 22*c* is formed with a plurality of tractor pins 21*d* coming into engagement with the indexing holes of the paper P.

The back-tension rollers 23 are disposed between the first and the second tractors 21~22 for exerting a suitable tension on the paper P being forwarded along the paper transfer path.

The scuff rollers 24 are disposed downstream from the drum 11 along the paper transfer path. The scuff rollers 24 exert a forward pulling force on the paper P, so that the paper P is properly forwarded from the fixing unit 19 to an undepicted paper stacker.

Though not shown in FIG. 1, a paper guide may be provided along the paper transfer path for preventing the paper P from deviating from the prescribed path.

Figure 2:
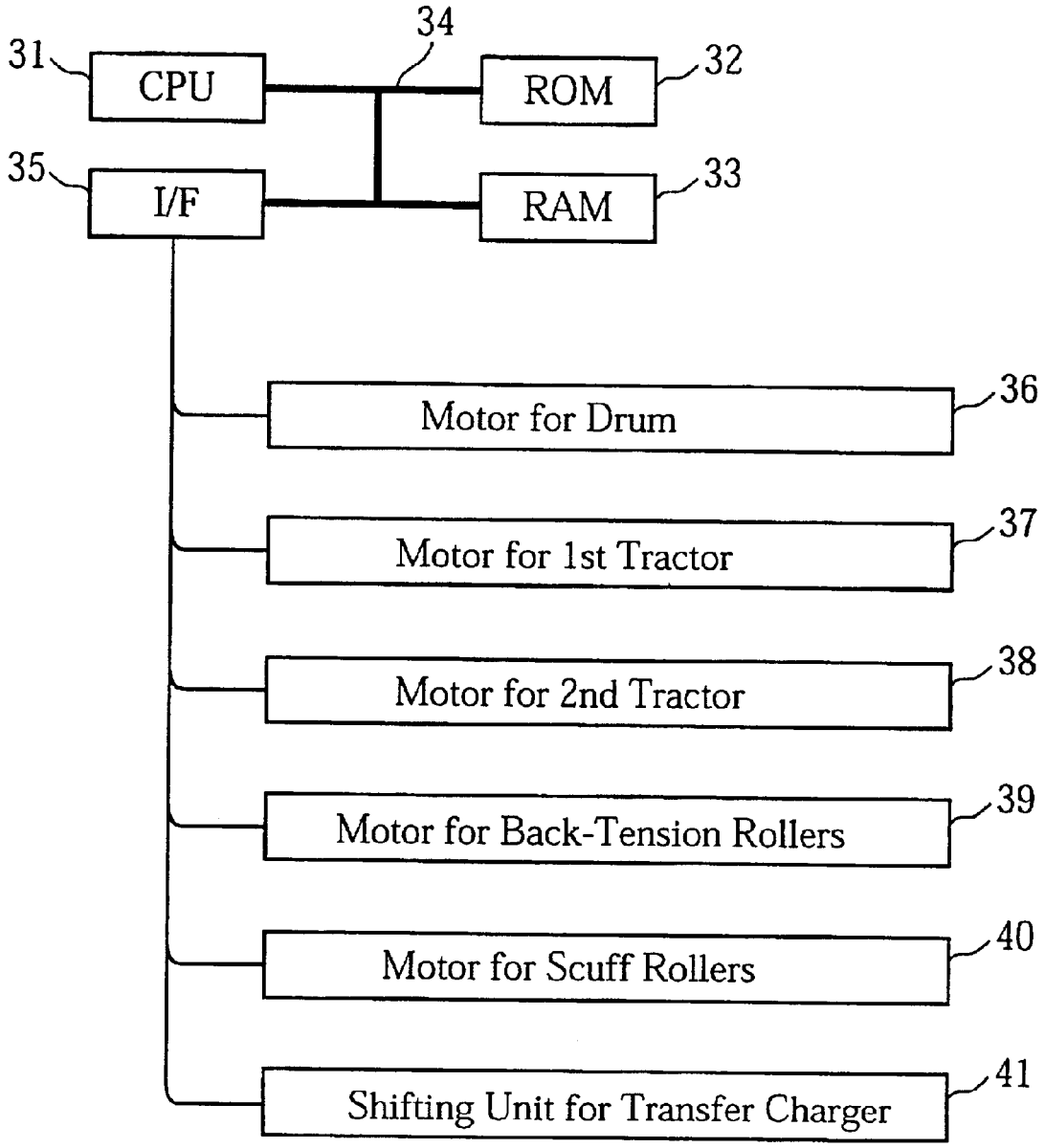
FIG. 2 is a block diagram showing several driving motors or shifting unit used for the printer of FIG. 1.

Reference is now made to FIG. 2 illustrating the electrical arrangements of the printer. As shown, the printer includes a central processing unit (CPU) 31, a read-only memory (ROM) 32 and a random-access memory (RAM) 33 connected to each other via buses 34 to which an interface (I/F) 35 is also connected. The interface 35 is connected to several actuators such as a driving motor 36 for the photosensitive drum 11, a driving motor 37 for the first tractor 21, a driving motor 38 for the second tractor 22, a driving motor 39 for the back-tension rollers 23, a driving motor 40 for the scuff rollers 24, and a shifting unit 41 for the transfer discharger 15.

The CPU 31 regulates and integrates the operations of the printer. Specifically, based on the instructions from a host computer connected to the printer, the CPU 31 operates the relevant components so that desired information is properly printed on the paper P.

The ROM 32 stores programs needed for operation of the printer and various kinds of predetermined initial values or reference values.

The RAM 33 provides the CPU 31 with a working area. For instance, the RAM 33 stores a bit-map form of printing data supplied from the host computer.

The above-mentioned driving motors 36~40 are operated by the instructions from the CPU 31 for actuating the photosensitive drum 11, the first and second tractors 21~22, the back-tension rollers 23 and the scuff rollers 24, as required. Also, the shifting unit 41 for the transfer charger 15 is operated by the instructions from the CPU 31 for moving the transfer charger 15 closer to or farther from the photosensitive drum 11.

The controlling of the printer will now be described with reference to the flow chart of FIG. 3 and the timing chart of FIG. 4.

Figure 3:
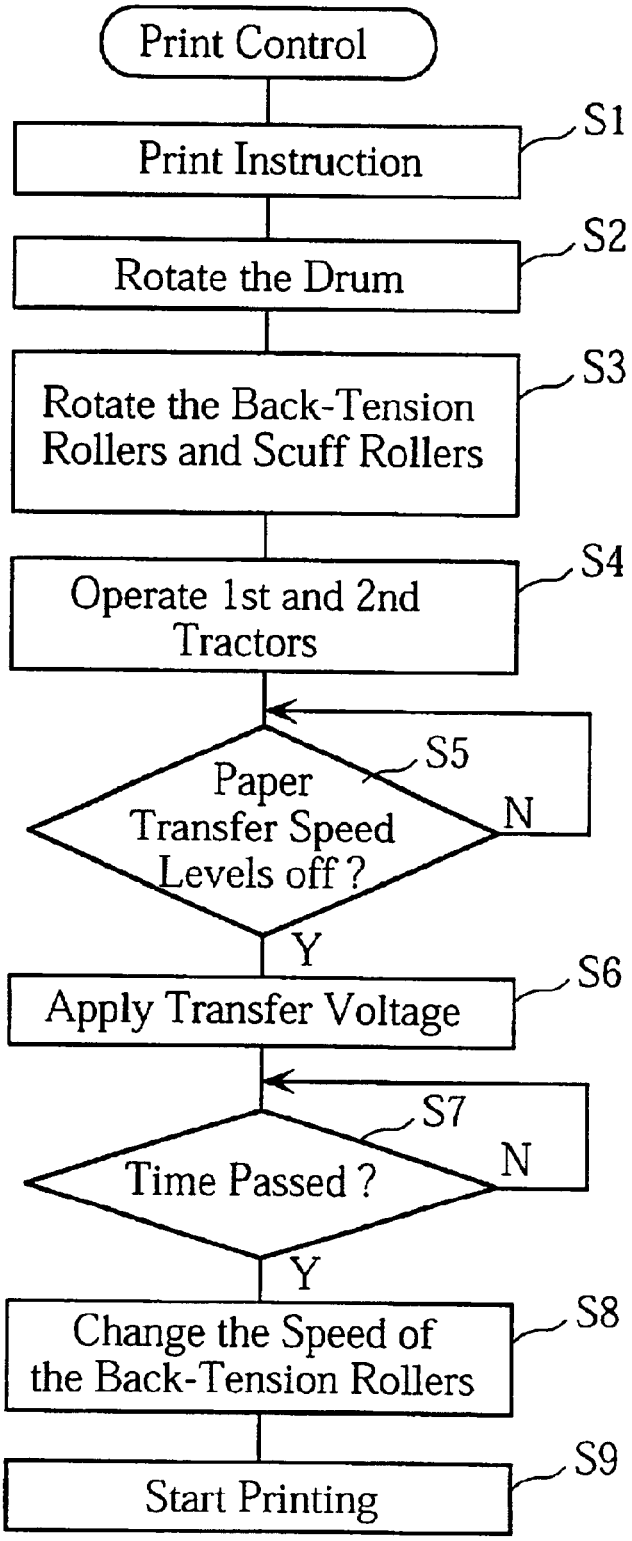
FIG. 3 is a flow chart illustrating a printing process carried out in the printer of FIG. 1.

When the host computer issues a printing instruction, or the user presses a start button for printing, the CPU 31 recognizes the print requirement (S1 in FIG. 3). Upon this, the CPU 31 sends a control signal to the driving motor 36 to rotate the drum 11 (S2).

Then, the CPU 31 sends a control signal to the driving motors 39 and 40 to rotate the back-tension rollers 23 and the scuff rollers 24 (S3). Upon rotation of the back-tension rollers 23 (see t0-point in FIG. 4), the feeding of the paper P begins.

Then, the CPU 31 sends a control signal to the driving motors 37 and 38 to actuate the first and the second tractors 21, 22 (S4).

At this stage, the back-tension rollers 23 and the scuff rollers 24 are operated so that their circumferential speeds are equal to each other. Specifically, under the control of the CPU 31, the back-tension rollers 23 is made to have a circumferential speed Vb1 which is greater than the transfer speed of the paper P by the second tractor 22.

When the revolution speed of the drum 11 reaches a predetermined value, the CPU 31 determines whether the transfer speed of the paper P by the second tractor 22 substantially levels off (S5). When the paper transfer speed becomes substantially constant (S5:YES), a prescribed transfer voltage is applied to the paper P (S6). Specifically, the CPU 31 sends a control signal to the shifting unit 41 for causing the transfer charger 15 to move upward so that the charger 15 comes into contact with the paper P. Upon contacting, the transfer charger 15 applies a transfer voltage to the paper P (this happens at t1-point in FIG. 4).

As the transfer charger 15 exerts more pressure on the paper P, the forward pulling force of the drum 11 with respect to the paper P becomes greater.

After the transfer charger 15 begins to apply the transfer voltage, the CPU 31 determines whether a predetermined period of time T has passed (S7). As shown in FIG. 4, the period T is a time taken for the forward pulling force of the drum 11 to increase to a predetermined value Fd.

Figure 4:
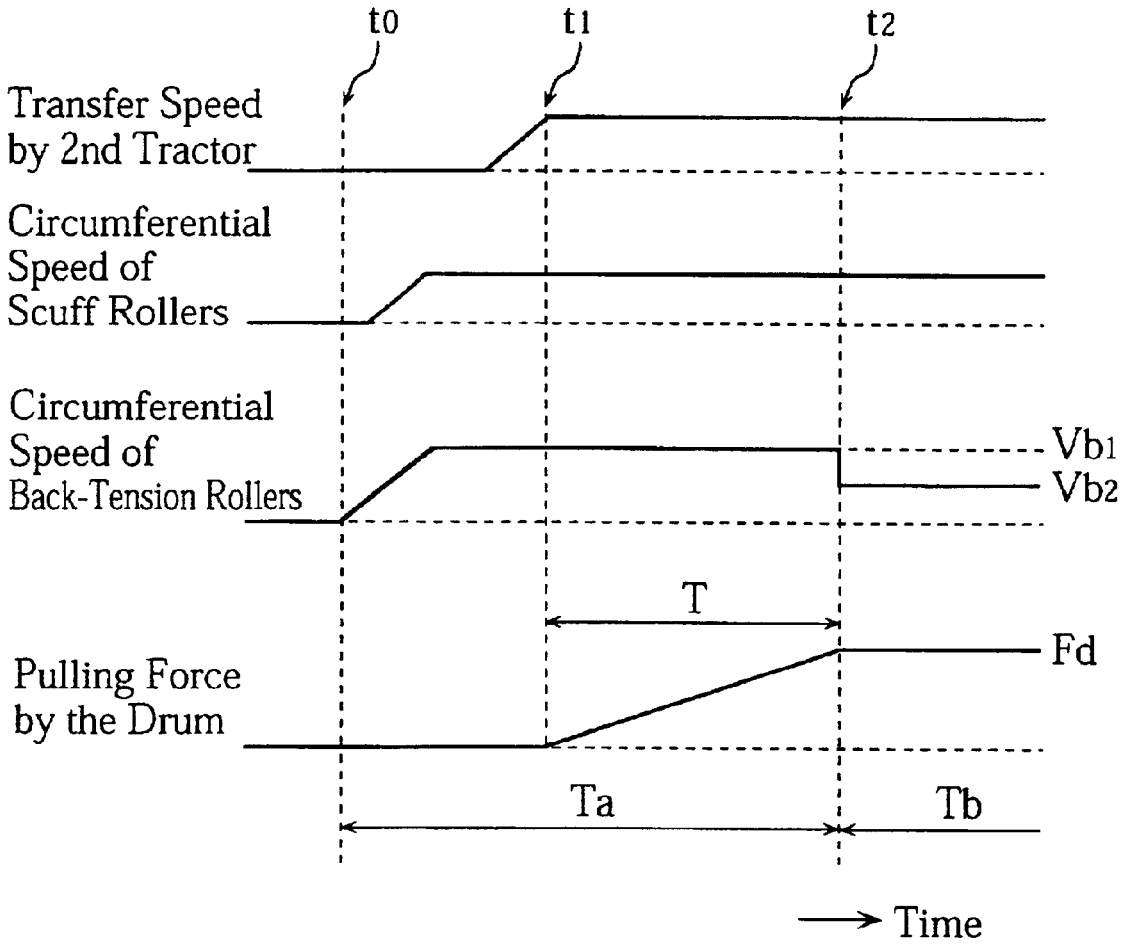
FIG. 4 is a timing chart illustrating how particular components of the printer are operated.

When the CPU 31 determines that the period T has passed (S7:YES), in other words, when the forward pulling force of the drum 11 becomes equal to the value Fd, the printing operation begins (t2-point in FIG. 4). Upon this, the CPU 31 sends a control signal to the driving motor 39 so that the circumferential speed of the back-tension rollers 23 is reduced to Vb2 (S8) which is smaller than the current paper transfer speed.

Figure 5:
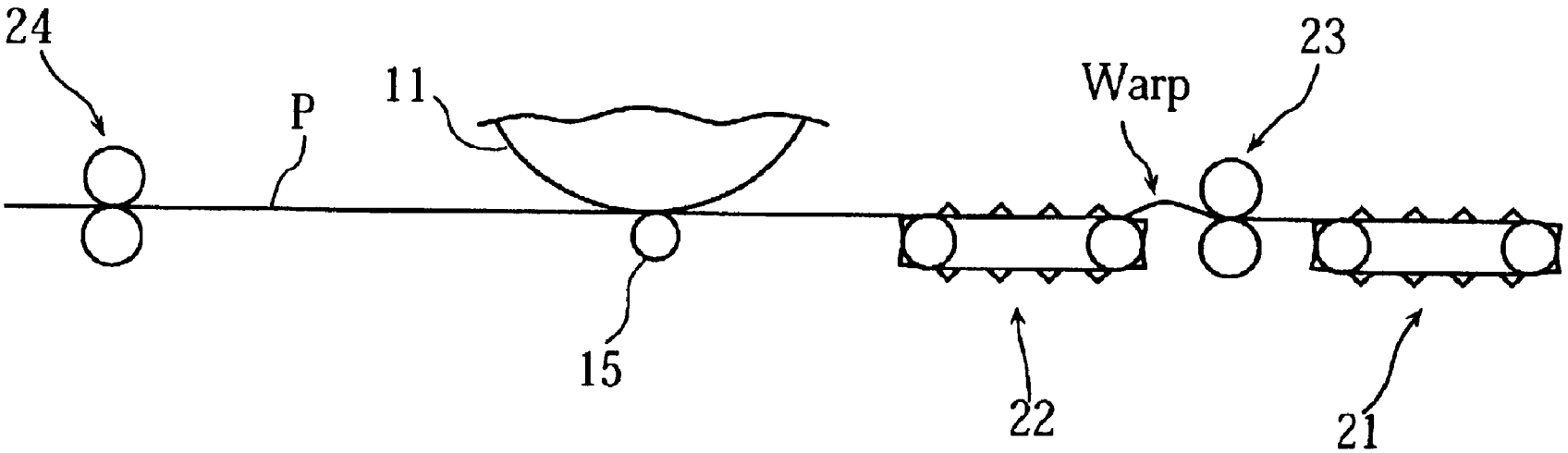
FIGS. 5~7 show the transfer condition of the recording paper used for the printer of FIG. 1.
Figure 6:
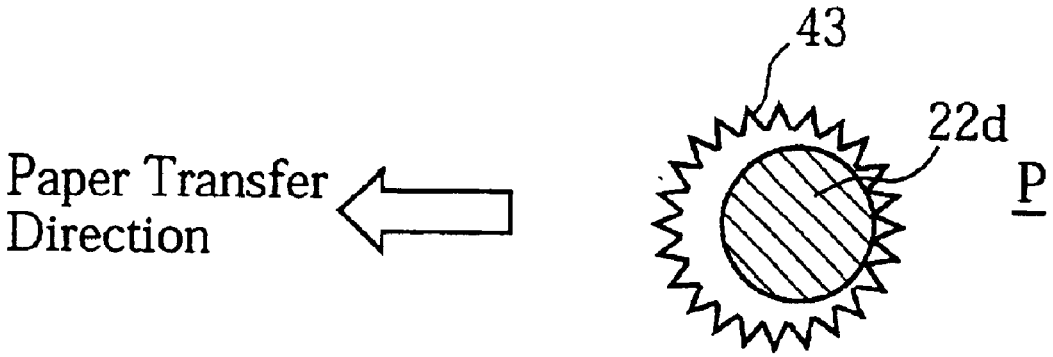

In the above-described controlling manner, the circumferential speed of the back-tension rollers 23 is made greater than the paper transfer speed during the period Ta (t0~t2) shown in FIG. 4. Therefore, the paper P is additionally pushed forward by the back-tension rollers 23, thereby warping between the second tractor 22 and the back-tension rollers 23, as shown in FIG. 5. Due to this warping, as shown in FIG. 6, the tractor pin 22*d* is held in contact with the rear portion of the indexing hole 43.

Figure 7:
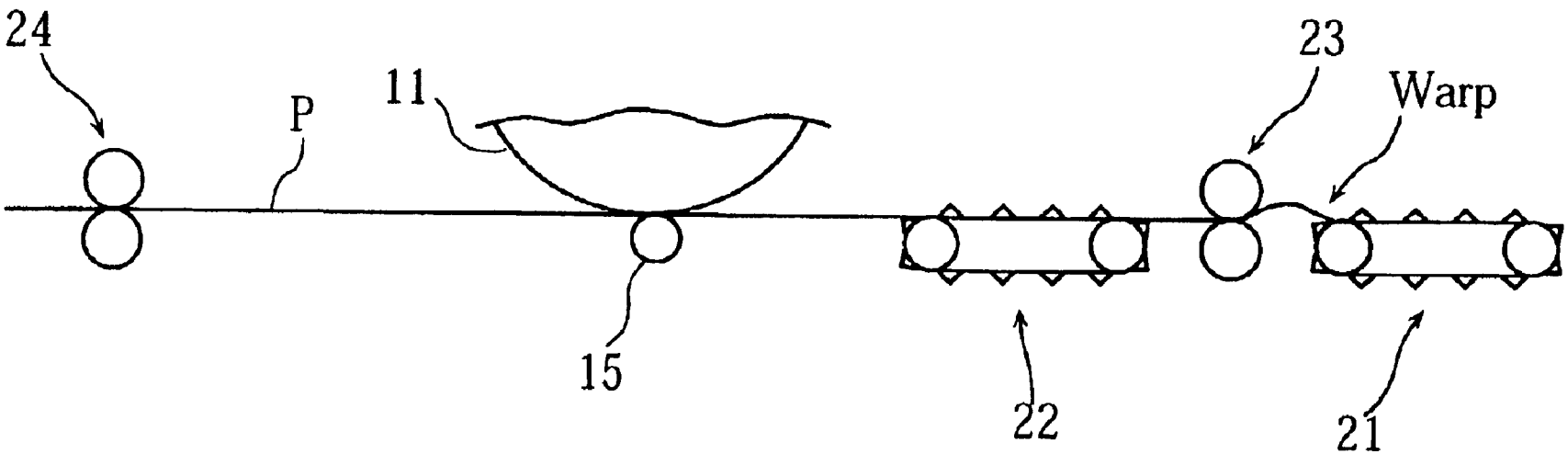

After a laps of Ta (t2~), the circumferential speed of the back-tension rollers 23 is made smaller than the paper transfer speed. Thus, the back-tension rollers 23 exert a backward pulling force on the paper P. At this stage, however, the total pulling force by the drum 11 and the scuff rollers 24 is greater than the backward pulling force by the back-tension rollers 23. Thus, the paper P is forwarded along the paper transfer path. In this instance again, the tractor pin 22*d* is held in contact with the rear portion of the indexing hole 43, as shown in FIG. 6. The warping of the paper P, however, occurs between the back-tension rollers 23 and the first tractor 21, as shown in FIG. 7.

As stated above, the paper P is forwarded along the transfer path, with the initial contacting relation to the tractor pins 22*d* of the second tractor 22 kept through the first period Ta and the subsequent period Tb. Thus, it is possible to overcome the conventional problem of printing deviation, whereby high-quality printing results can be expected.

Figure 8:
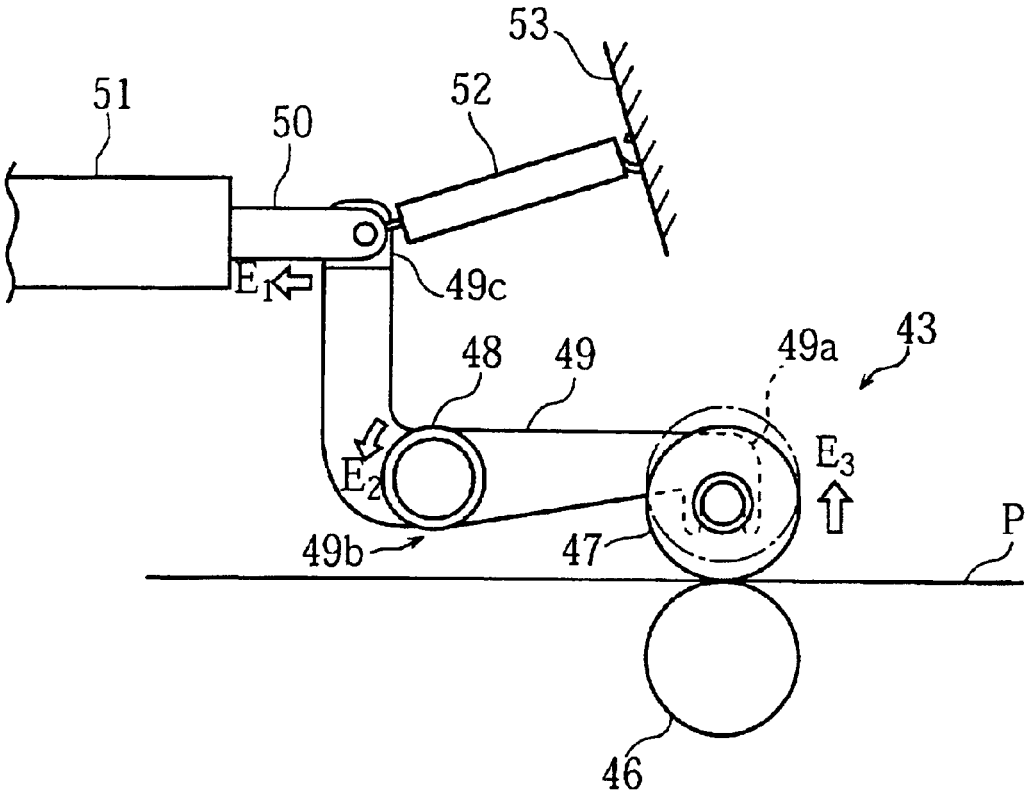
FIG. 8 shows a modified arrangement for the back-tension rollers of the printer of FIG. 1.

Reference is now made to FIG. 8 illustrating a modified version of the back-tension roller mechanism. In the above-described embodiment, the circumferential speed of the back-tension rollers 23 is changed for preventing printing deviation on the paper P. In the following example, a different technique is employed for the deviation preventing purpose.

Specifically, as shown in FIG. 8, the back-tension rollers of the modified version may include a rotatably supported feed roller 46 and a pinch roller 47. Continuous paper P is held between the feed roller 46 and the pinch roller 47. In operation, the feed roller 46 may be rotated by the driving motor 39 (see FIG. 2).

The pinch roller 47 is rotatably attached to an end 49*a* of a generally L-shaped arm 49. At its central portion 49*b*, the arm 49 is supported by a shaft 48 about which the arm 49 is rotatable. At the opposite end 49*c*, the arm 49 is connected to a rod 50 which in turn is connected to a linear actuator (solenoid) 51. The end 49*c* of the arm 49 is associated with a coil spring 52 fixed to a stationary portion 53 of the image-forming apparatus.

The linear actuator 51 may be connected to the CPU 31 (FIG. 2) via the interface 35. In this instance, based on a control signal supplied from the CPU 31, the actuator 51 moves the rod 50 in the E1-direction or the opposite direction.

With the above arrangement, the CPU 31 is responsible for the following operations during the initial period Ta (see FIG. 4). Specifically, the CPU 31 operates the actuator 51 to move the rod 50 in the E1-direction shown in FIG. 8. Accordingly, the arm 49 is rotated about the shaft 48 in the E2-direction (anticlockwise in the figure), as expanding the spring 52. Upon rotation of the arm 49, the pinch roller 47 is raised off the paper P (see the arrow E3).

While the pinch roller 47 is spaced away from the paper P, the back-tension rollers 43 cannot exert a pulling force on the paper P. Thus, at this stage, the paper P is mainly forwarded by the scuff rollers 24. As a result, the forwarding of the paper P is performed with the tractor pins 22*d* held in contact with the rear portion of the indexing holes 43, as shown in FIG. 6.

When the actual image-printing is begun (t2-point in FIG. 4), the CPU 31 causes the back-tension rollers 43 to apply pressure on the paper P. Specifically, the CPU 31 stops sending the driving signal to the actuator 51, so that the rod 50 returns to the initial position by the action of the spring 52. Accordingly, the arm 49 is rotated clockwise in FIG. 8 about the shaft 48, thereby causing the pinch roller 47 to come down into pressing contact with the paper P.

Then, the CPU 31 sends a control signal to the driving motor 39 (FIG. 2). Thus, the feed roller 46 begins to rotate, exerting an appropriate pulling force on the paper P. At this stage, the scuff rollers 24 and the photosensitive drum 11 pull forward the paper P, so that the tractor pins 22*d* are kept in contact with the rear portions of the indexing holes 43.

In the above modified arrangement again, the conventional print deviation is prevented since the backward offset positioning of the tractor pins in the indexing holes is maintained before and after the printing operation starts.

Figure 9:
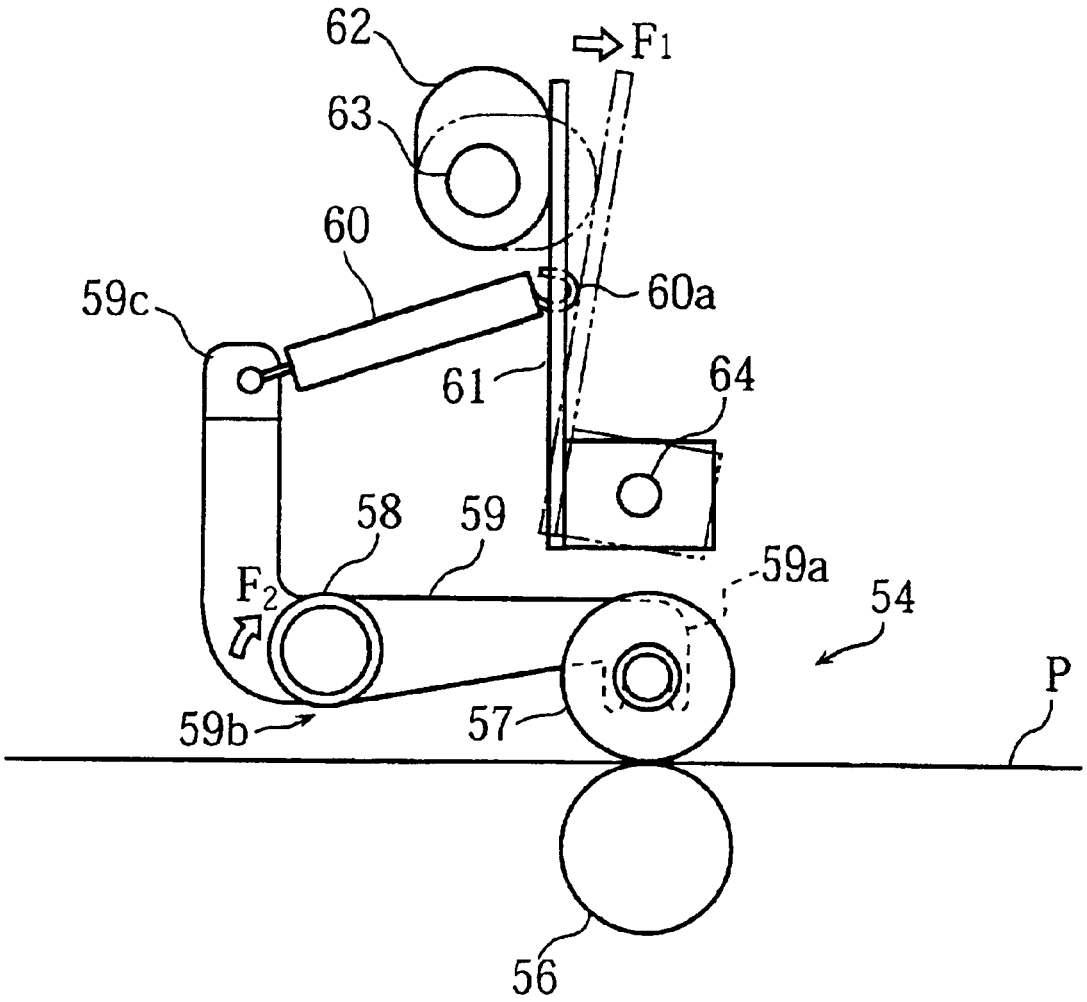
FIG. 9 shows a modified arrangement for the scuff rollers of the printer of FIG. 1.
Figure 10:
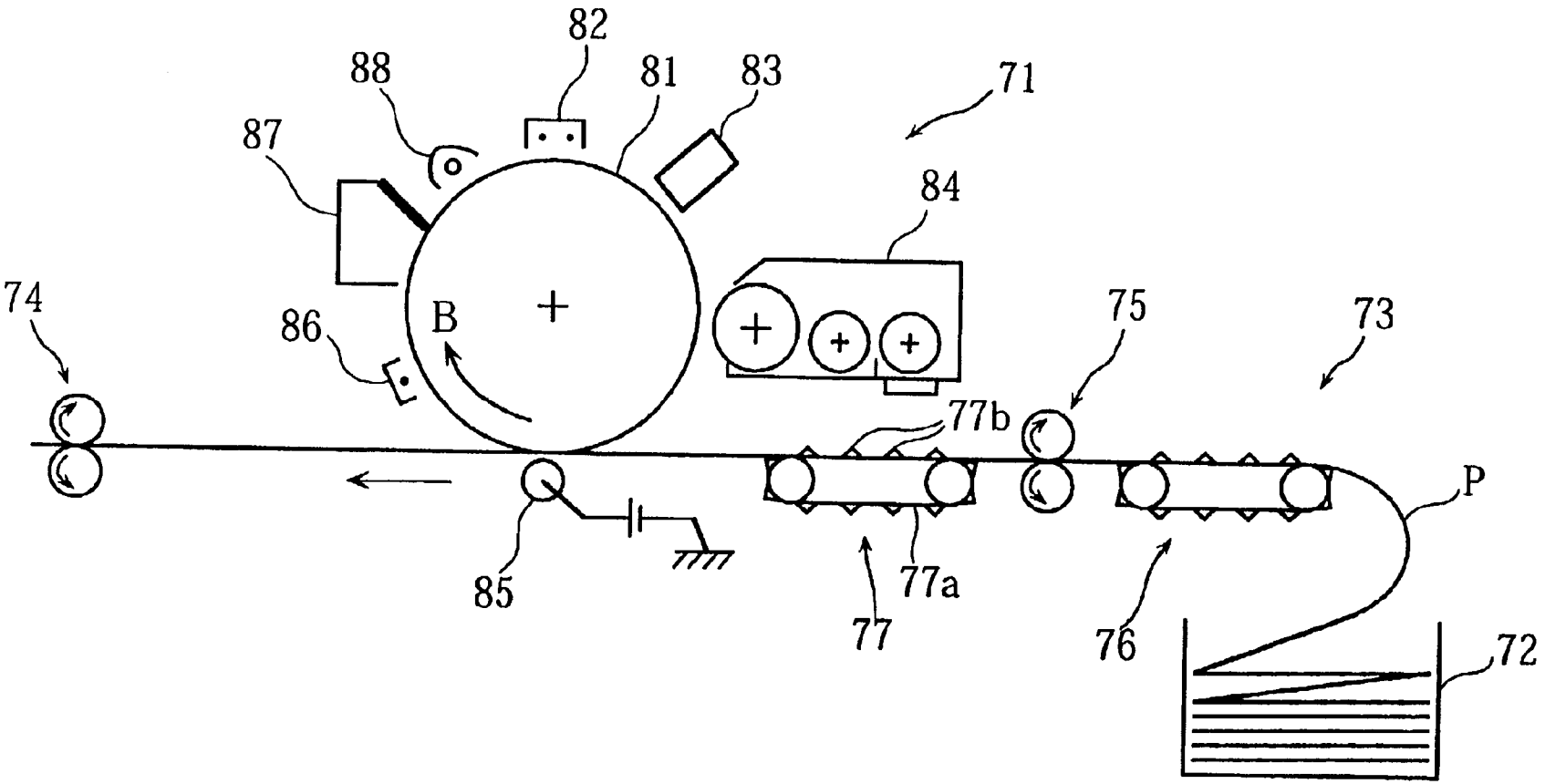
FIG.10 PRIOR ART
FIG. 10 shows the principal components of a conventional printer.
Figure 11:
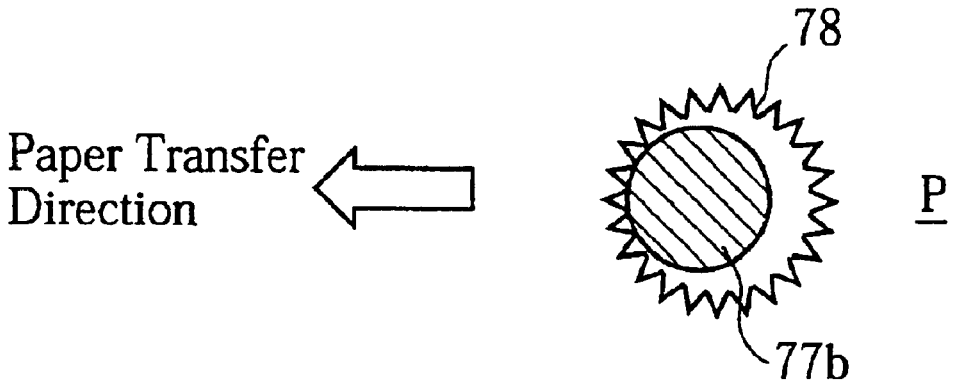
FIG.11 PRIOR ART
FIGS. 11 and 12 show the positional relation between a tractor pin and an indexing hole of recording paper used for the conventional printer.
Figure 12:
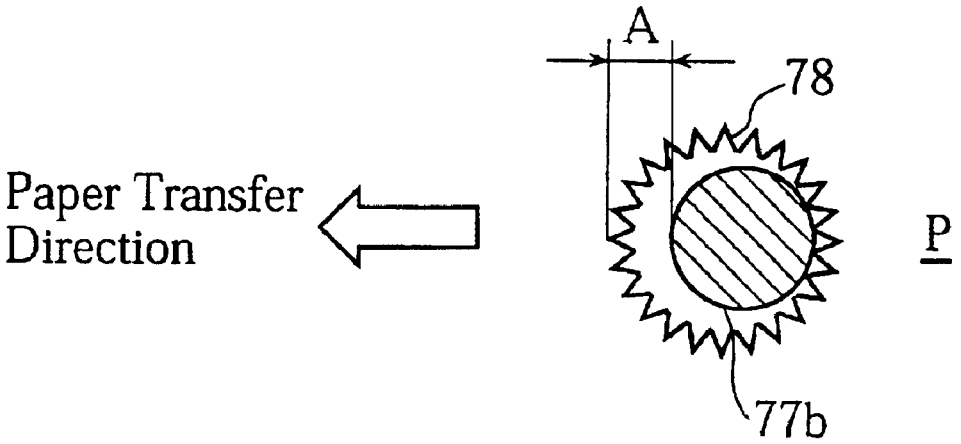
FIG.12 PRIOR ART

FIG. 9 shows another possible modification to be made for the image-forming apparatus of the present invention. The modification concerns the scuff rollers 54.

Specifically, the scuff rollers 54 include a feed roller 56 and a pinch roller 57 between which the paper P is held. The feed roller 56 is rotated by the driving motor 40 (FIG. 2).

The pinch roller 57 is rotatably attached to an end 59*a* of a generally L-shaped arm 59. At its central portion 59*b*, the arm 59 is rotatably supported by a shaft 58. At the other end 59*c*, the arm 59 is associated with a coil spring 60 provided with a hook 60*a* for engagement with a plate 61. At an upper portion, the plate 61 comes into contact with a cam 62 which is fixed to a shaft 63. The plate 61 is rotatable about a shaft 64.

The cam shaft 63 is revolved by a undepicted motor. This motor, connected to the CPU 31 of FIG. 2 via the interface 35, operates based on a control signal from the CPU 31. The motor in operation causes the cam 62 to rotate on the shaft 63.

With the above arrangement, the CPU 31 causes the scuff rollers 54 to pull the paper P more stronger than the back-tension rollers 43 during the initial period Ta (FIG. 4). Specifically, the CPU 31 operates the cam motor to rotate the cam 62 through an appropriate angle. Accordingly, the plate 61 is rotated about the shaft 63 in the F1-direction shown in FIG. 9, thereby rotating the arm 59 in the F2-direction. Thus, the pinch roller 57 comes into pressing contact with the paper P. The pressure acting on the paper P becomes greater as the plate 61 rotates further in the F1-direction, thereby increasing the paper pulling force by the scuff rollers 54. As a result, the paper P is pulled forward by a force sufficient to cause the tractor pins 22*d* to come into contact with the rear portions of the indexing holes 43, as shown in FIG. 6.

After the toner image transfer operation begins, the CPU 31 reduces the paper pulling force of the scuff rollers 54. Specifically, the CPU 31 operates the cam driving motor to rotate the cam 62 further from the active position (shown by two-dot chain lines in FIG. 9), thereby allowing the plate 61 to return to the initial position (shown by solid lines). Accordingly, the arm 59 is rotated about the shaft 58 in the opposite direction to the F2-direction, thereby reducing the pressure of the scuff rollers 54 acting on the paper P. As a result, the paper pulling force of the scuff rollers 54 becomes weaker.

However, during the toner image transfer process, the photosensitive drum 11 pulls forward the paper P with an appropriately strong force so that the total pulling force of the rollers 54 and the drum 11 is greater than the tension exerted by the back-tension rollers 23. Thus, in this situation again, the tractor pins 22*d* are held in contact with the rear portions of the indexing holes 43 while the paper P is being forwarded along the paper transfer path.

As described above, the present invention is advantageous to preventing the positional deviation of the tractor pins in the indexing holes of recording paper. Accordingly, high-quality printing results can be expected.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. An image-forming apparatus comprising:

a photosensitive member on which an electrostatic latent image is produced; scuff rollers that move recording paper along a transfer path;

a tractor disposed upstream of the transfer path from the scuff rollers, the tractor moving the recording paper at a predetermined transfer speed;

back-tension rollers disposed upstream from the tractor, the back-tension rollers exerting a tension on the recording paper; and a speed controller that adjusts a transfer speed of the recording paper;

wherein the speed controller makes greater a circumferential speed of the back-tension rollers than the transfer speed by the tractor during a period after the recording paper is started to move along the transfer path and before image-printing is begun.

2. An image-forming apparatus comprising:

a photosensitive member on which an electrostatic latent image is produced;

scuff roller that move recording paper along a transfer path;

a tractor disposed upstream of the transfer path from the scuff rollers, the tractor moving the recording paper at a predetermined transfer speed;

back-tension rollers disposed upstream from the tractor, the back-tension rollers exerting a tension on the recording paper; and a speed controller that adjusts a transfer speed of the recording paper;

wherein the speed controller makes smaller the circumferential speed of the back-tension rollers than the transfer speed by the tractor after the image-printing is begun.

3. The apparatus according to claim 2, further comprising a transfer charger for transferring a toner image onto the recording paper, wherein the speed controller makes smaller the circumferential speed of the back-tension rollers than the transfer speed by the tractor after a predetermined period of time passes since a beginning of transfer by the transfer charger.

4. An image-forming apparatus comprising:

an image-forming unit that prints an image on recording paper;

scuff rollers that move the recording paper along a transfer path;

a tractor disposed upstream of the transfer path from the scuff rollers, the tractor moving the recording paper at a predetermined transfer speed;

back-tension rollers disposed upstream from the tractor for exerting a tension on the recording paper; and a pressure controller that adjusts a pressing force acting on the recording paper;

wherein the pressure controller prevents the back-tension rollers from exerting a pressing force on the recording paper during a period after the recording paper is started to move along the transfer path and before image-printing is begun.

5. The apparatus according to claim 4, wherein the pressure controller controls the back-tension rollers after the image-printing is begun, so that the back-tension rollers exert a pressing force on the recording paper.

6. The apparatus according to claim 4, further comprising a transfer charger for transferring a toner image onto the recording paper, wherein the pressure controller causes the back-tension rollers to exert a pressing force on the recording paper after a predetermined period of time passes since a beginning of transfer by the transfer charger.

7. The apparatus according to claim 4, further comprising a mechanism for changing a position of the back-tension rollers, wherein the pressure controller controls the position-changing mechanism for causing the back-tension rollers to selectively exert a pressing force on the recording paper.

8. The apparatus according to claim 7, wherein the back-tension rollers include a drive roller and a follower roller which faces the drive roller and is moved by the position-changing mechanism.

9. An image-forming apparatus comprising:

an image-forming unit including a photosensitive member on which an electrostatic latent image is produced;

scuff rollers that move recording paper along a transfer path;

a tractor disposed upstream of the transfer path from the scuff rollers, the tractor moving the recording paper along the transfer path at a predetermined transfer speed;

back-tension rollers disposed upstream from the tractor for exerting a tension on the recording paper; and a pull controller that adjusts a pulling force acting on the recording paper;

wherein a pulling force of the scuff rollers during a period after the recording paper is started to move along the transfer path and before image-printing is begun is made greater by the pull controller than a pulling force of the scuff rollers after the image-printing is begun.

10. The apparatus according to claim 9, wherein the pull controller makes greater a sum of the pulling force of the scuff rollers and pulling force of the photosensitive member than the pulling force of the back-tension rollers after the image-printing is begun.

11. The apparatus according to claim 9, further comprising a transfer charger for transferring a toner image onto the recording paper, wherein the pull controller makes greater a sum of the pulling force of the scuff rollers and the pulling force of the photosensitive member than the pulling force of the back-tension rollers after a predetermined period of time passes since a beginning of transfer by the transfer charger.

12. The apparatus according to claim 9, further comprising a pressure adjusting mechanism for the scuff rollers, wherein the pull controller controls the pressure adjusting mechanism, thereby changing the pressing force of the scuff rollers acting on the recording paper.

13. The apparatus according to claim 12, wherein the scuff rollers include a drive roller and a follower roller which faces the drive roller and is associated with the pressure adjusting mechanism.

14. The apparatus according to claim 11, wherein said predetermined period of time is determined depending on a forward pulling force of the photosensitive member acting on the recording paper.

* * * * *